United States Patent [19]

Thompson

[11] Patent Number: 4,866,818

[45] Date of Patent: Sep. 19, 1989

[54] PINCH CLIP

[76] Inventor: John P. Thompson, 3821 West Valley Dr., Fairview Park, Ohio 44126

[21] Appl. No.: 286,605

[22] Filed: Dec. 19, 1988

[51] Int. Cl.[4] ..... B65D 77/18

[52] U.S. Cl. ..... 24/543; 24/30.5 P

[58] Field of Search ..... 24/543, 30.5 R, 30.5 P, 24/10 R, 11 CC, 132 R, 132 WL; 128/346

[56] References Cited

U.S. PATENT DOCUMENTS

| | | | |
|---|---|---|---|
| 1,222,948 | 4/1917 | Hawthorne | 24/10 R |
| 2,645,514 | 7/1953 | Mitchko | 24/30.5 P |
| 3,176,951 | 4/1965 | McFadyen et al. | 24/10 R |
| 3,713,622 | 1/1973 | Dinger | 24/543 |
| 3,766,925 | 10/1973 | Rubricius | 24/543 |
| 4,296,529 | 10/1981 | Brown | 24/30.5 P |
| 4,453,295 | 6/1984 | Laszczower | 24/543 |
| 4,551,888 | 11/1985 | Beecher | 24/30.5 P |
| 4,623,102 | 11/1986 | Hough, Jr. | 24/543 |

FOREIGN PATENT DOCUMENTS

| | | | |
|---|---|---|---|
| 0156779 | 10/1985 | European Pat. Off. | 24/30.5 R |

*Primary Examiner*—Victor N. Sakran

*Attorney, Agent, or Firm*—Thomas M. Schmitz

[57] ABSTRACT

The invention pertains to a locking pinch clip useful for securing plastic bags or securing one article to another and the like. The pinch clip consists of integral rigid plastic comprising a base, an upright locking means, and a resiliently hinged diagonal member adapted to pinch toward the base to engage and lock with the upright locking means.

4 Claims, 1 Drawing Sheet

GREETING CARD
10
12
14
16
17
18
20
22
24
26
30
32
34
36
40
44
46

PINCH CLIP

BACKGROUND OF THE INVENTION

This invention pertains to a clip means and more particularly to a locking pinch clip useful for securing plastic bags or securing one article to another. The pinch clip can be securely locked and maintained locked while in use.

Means for securing plastic bags such as plastic food bags or plastic refuse bags are known but ordinarily are relatively simple structures, such as twisted wires or threaded plastics and the like, which serve the purpose, but quite often secure the bag inadequately. The contents weight of the bag for instance can cause the twisted wires to unravel or otherwise loosen. Similarly, simple attachment means for connecting one article to another or suspending an article from an overhead supporting means are known but quite often are unsightly and insecure.

It now has been found that a simple but efficient locking pinch clip consisting of integral rigid plastic construction comprising a base, an integral upright locking means and an integral hinged diagonal locking member provides a versatile clip for a variety of purposes. The pinch clip can be easily secured in locking engagement by pinching together the diagonal member and upright locking means but cannot be disengaged by reverse outward movement of the diagonal locking member. The locked pinch clip can be unlocked only by sliding the diagonal locking member laterally relative to the upright locking means. The pinch clip is simple in construction, easily secured in pinching engagement, and very secure in use, and useful for ornamental as well as utilitarian purposes. For instance, the pinch clip can secure the open end of a plastic bag or secure two items together. The base of the pinch clip can be adhered or otherwise secured to a surface such as a baseboard and hold an electrical wire or decorative cord. The pinch clip can be manufactured efficiently by thermoplastic molding of clear or colored rigid plastic. These and other advantages of this invention will become more apparent by reference to the drawings as well as the detailed description of the invention.

IN THE DRAWINGS

SUMMARY OF THE INVENTION

Figures 1, 2, 3, 4, 5, 6:
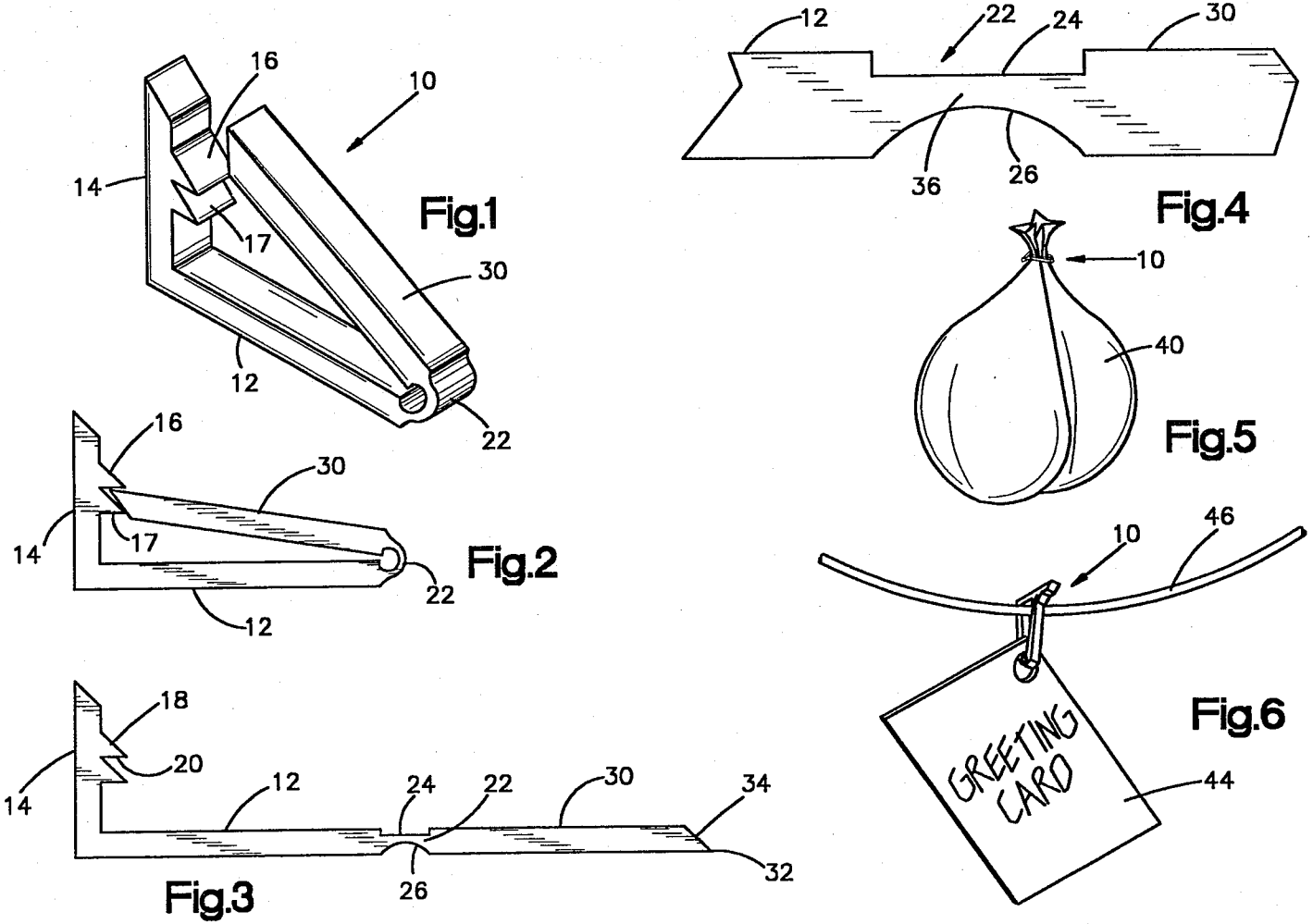
FIG. 1 is a perspective view of the rigid plastic pinch clip of this invention.
FIG. 2 is an enlarged side elevation view of the pinch clip shown in FIG. 1.
FIG. 3 is a side elevation view of the pinch clip in FIG. 2 showing the pinch clip in a stretched-out position.
FIG. 4 is a further enlarged partial view of the pinch clip in FIG. 3.
FIG. 5 is a side elevation view of a plastic refuse bag locked by the pinch clip in use.
FIG. 6 is a side elevation view of a greeting card attached to an overhead string by the pinch clip shown in FIG. 1.

Briefly, the invention comprises a plastic pinch clip consisting of an integral rigid plastic structure comprising a base member integral with an upright locking means at one end and with a hinged diagonal locking means at the other end, where the hinged diagonal locking member is adapted to bend backwardly toward the base and engage the upright locking means. The upright locking means contains an inwardly directed locking tooth or teeth adapted to slideably engage the distal end of the diagonal locking member upon pinching the base and diagonal members together. The locking means irreversibly provides locking engagement of the distal end of the diagonal member with the locking tooth.

DETAILED DESCRIPTION OF THE INVENTION

Referring now to the drawings wherein like characters designate like parts, shown in FIG. 1 is a perspective view of the pinch clip 10 of this invention.

In FIGS. 2 and 3, the pinch clip 10 is shown in an enlarged side elevation view comprising a base member 12 integral at one end with a right angle upright locking means 14 containing inwardly extended triangular teeth 16, 17 rigidly integral with the upright locking means 14. Each tooth 16, 17 comprises an angular or downwardly directed engaging surface 18 and a lower locking surface 20 disposed substantially parallel to the base 12. At the other end of the base 12, a resilient hinge means 22 integrally interconnects the base 12 with a diagonal locking member 30. The resilient hinge means 22 is adapted to flex or bend the diagonal member 30 backwardly toward the locking teeth 16, 17 and the base 12. The diagonal locking member 30 terminates in a pointed distal end 32 preferably comprising a downwardly directed slanted surface 34 as viewed in FIG. 3, whereby the slanted surface 34 is adapted to slideably engage the angular upper engaging surface 18 of the upper tooth member 16 upon bending the diagonal locking member 30 backwardly toward the right angular upright locking means 14 as shown in FIG. 2. The pinch clip 10 is locked by pinching the diagonal member 30 and base 12 together and forceably sliding the inverted slanted surface 34 of the diagonal distal end 32 downwardly over the angular upper engaging surface 16 and causing the pointed distal end 32 to engage the underside or lower locking surface 20 of the inwardly protruding triangular upper tooth 16, as viewed in FIG. 2. Preferably the diagonal locking member 30 is slightly oversize in length relative to the linear length of the base 12 to provide secure compressive locking engagement with the upright locking means 14.

In a preferred embodiment of this invention shown in the enlarged view in FIG. 4, the integral resilient hinge means 22 interconnecting the base 12 with the diagonal locking member 30 comprises a concave lower structure 26 on the outside of the base 12 and an opposed upper flat indent 24 on the inside of the base 12 to form an intermediate resilient hinged neck structure 36 which provides limited resiliency in the hinge section 22 of the otherwise rigid plastic pinch clip 10.

In use, the pinch clip 10 can be used to lock a plastic bag 40 such as a plastic food bag, plastic point of sale bag, or plastic refuse bag as shown in FIG. 5, or to secure one article to another such as attaching a greeting card 44 to an overhead cord or string 46 as shown in FIG. 6. Similarly, the exterior surface of the base 12 can be adhered or secured to a surface whereupon clipped items such as cards, wires or strings can be secured within the pinch clip 10. Pinch clips 10 can be molded rigid plastic produced by thermoplastic molding processes in an outstretched configuration as shown in FIG. 3. The pinch clip 10 can be molded from rigid thermoplastic materials such as polyethylene, polypropylene, or polyvinylchloride. The pinch clip 10 can be attached or secured to one or more articles by locating a part of the article or articles between the base 12 and the diagonal member 30 by bending the diagonal member 30 backwardly toward the upright locking means 14 and pinching the diagonal member 30 toward the base 12, whereby the distal end 32 slideably engages the downwardly depending upper angular surface 18 of the inwardly protruding triangular tooth 16. By applying an additional pinching force, the distal end 32 continues sliding engagement with the upper engaging surface 18 until the distal end 32 of the diagonal member 30 passes over the upper surface 18 and drops downwardly to provide locking engagement with the lower, horizontally disposed locking surface 20 of the locking tooth member 16, thereby locking the pinch clip 10 and securing the article or articles disposed within the pinch clip 10.

Tighter locking engagement of the pinch clip 10 can be achieved by applying additional pinching pressure and forcing the pointed distal end 32 in similar manner to engage the lower triangular tooth 17. Although the upright locking means 14 is shown to contain both an upper tooth 16 and a lower tooth 17, it is readily seen that a single tooth 16 or several teeth can be provided.

The drawings and foregoing detailed description illustrate preferred embodiments of the pinch clip of this invention but are not intended to be limiting except by the appended claims.

I claim:

1. A pinch clip consisting of a molded integral rigid plastic construction, comprising an intermediate base member integrally interconnecting at one end with an upright locking means and at the other end with a diagonal locking member having a pointed distal end, said upright locking means comprising a right angular upright member having at least one inwardly protruding angular tooth member, the tooth member being triangular in shape and containing an upper engaging surface and a lower locking surface adapted to engage and lock the diagonal locking member by the diagonal locking member slideably engaging the upper surface to facilitate pinching engagement of the distal end with the lower surface of the angular tooth, where said diagonal locking member is slightly longer in length relative to the linear length of the base member to provide compressive engagement of the diagonal locking member with the angular tooth member, said base integrally interconnecting with said diagonal locking member by an integral resilient hinge means adapted to flex and enable the diagonal locking member to be bent backwardly toward the protruding tooth member and engage the lower locking surface of the angular tooth member of the upright locking means upon pinching the diagonal locking member toward the base to securely lock the diagonal locking member with the upright locking means, said integral hinge comprising an integral narrowed neck structure consisting of a concave lower outside structure and an opposed upper flat inside indent structure whereby the integral resilient hinge means is adapted to flex backwardly toward the inside of the pinch clip to lock with the upright locking means, said pinch clip attaching two separate articles together within the pinch clip.

2. The pinch clip in claim 1 where the upright locking means contains two or more protruding tooth members.

3. A method of securing a pinch clip to attach two articles, comprising:

protruding an integral pinch clip of rigid plastic construction, the pinch clip comprising a base member integrally interconnected with a right angular upright locking means at one end and with a diagonal locking member at the other end, where the upright locking means contains an inwardly protruding triangular tooth having an upper engaging surface and a lower locking surface, where the diagonal locking member terminates in a pointed distal end adapted to engage the upright locking means, where the diagonal locking member is slightly longer in length relative to the linear length of the base member to provide compressive pinching engagement of the diagonal locking member with the triangular tooth, said base interconnected to the diagonal locking member by an integral resilient hinge means to enable the diagonal locking member to bend backwardly toward the upright locking means, said integral hinge means comprising an integral narrowed neck structure consisting of a concave lower structure on the outside and an opposed flat indent structure on the inside whereby the resilient hinge means is adapted to flex backwardly toward the inside of the pinch clip and the diagonal locking member is adapted to lock with the upright locking means;

attaching the pinch clip to two separate articles disposed within the pinch clip between the base member and the diagonal member and flexing the resilient hinge means backwardly toward the inside of the pinch clip for locking the diagonal locking member with the upright locking means;

pinching the diagonal member toward the base to provide sliding engagement of the distal end with the upper engaging surface of the protruding triangular tooth;

continuing sliding engagement of the distal end with the upper engaging surface of the protruding triangular tooth until the distal end of the diagonal member passes over the upper surface and provides locking engagement with the lower locking surface of the protruding triangular tooth to securely lock the pinch clip and secure the two articles within the pinch clip.

4. A pinch clip consisting of molded integral rigid plastic contruction for securing a plastic bag, the pinch clip comprising an intermediate base member integrally interconnected at one end with an upright locking means and at the other end with a diagonal locking member having a pointed distal end, said upright means comprising a rigid right angle upright member having two or more inwardly protruding angular tooth members, each tooth member being triangular in shape containing an upper engaging surface and a lower locking surface adapted to engage and lock the diagonal locking member by the diagonal locking member slideably engaging the upper surface to facilitate pinching engagement of the distal end with the lower surface of one of the triangular tooth members, said diagonal locking member being slightly longer in length relative to the linear length of the base member to provide compressive pinching engagement of the diagonal locking member with one of the protruding triangular tooth members, said base integrally interconnecting with said diagonal locking member by an integral resilient hinge means adapted to flex and enable the diagonal locking member to be bent backwardly toward the protruding tooth members and engage the lower locking surface of the angular tooth member upon pinching the diagonal toward the base to securely lock the diagonal locking member with the upright locking means, said integral hinge comprising an integral narrowed neck structure consisting of a concave lower outside structure and an opposed upper flat inside indent structure whereby the integral resilient hinge means is adapted to flex backwardly toward the inside of the pinch clip to lock with the upright means, said pinch clip in locking engagement with a plastic bag to secure the opening of the plastic bag.

* * * * *